US005176886A

United States Patent [19]

Darnall et al.

[11] Patent Number: 5,176,886

[45] Date of Patent: Jan. 5, 1993

[54] RAPID, AMBIENT-TEMPERATURE PROCESS FOR STRIPPING GOLD BOUND TO ACTIVATED CARBON

[75] Inventors: Dennis W. Darnall, Mesilla; Jorge L. Gardea-Torresdey; Robert A. McPherson, both of Las Cruces, all of N. Mex.

[73] Assignee: Bio-Recovery Systems, Inc., Las Cruces, N. Mex.

[21] Appl. No.: 644,724

[22] Filed: Jan. 23, 1991

[51] Int. Cl.[5] ..... C01G 7/00; B01D 15/04

[52] U.S. Cl. ..... 423/29; 423/24

[58] Field of Search ..... 423/29, 24

[56] References Cited

U.S. PATENT DOCUMENTS

| | | | |
|---|---|---|---|
| 3,935,006 | 1/1976 | Fisher | 75/118 R |
| 4,208,378 | 6/1980 | Heinen et al. | 423/27 |
| 4,372,830 | 2/1983 | Law | 423/24 |
| 4,427,571 | 1/1984 | Parker et al. | 252/364 |
| 4,968,346 | 11/1990 | Belsak et al. | 423/29 |

OTHER PUBLICATIONS

Robert S. Boikess and Edward Edelson, *Chemical Principles, 2d Ed.* (New York: Harper & Row Publishers), 1981, Chapter 15 "Acids and Bases," pp. 486–490.

Ralph H. Petrucci, *General Chemistry, Principles and Modern Applications, 2d Ed.* (New York: Macmillan Publishing Co., Inc.), 1977, Chapter 16 "Acids, Bases, and Ionic Equilibria," pp. 395–396.

Stephen Stoker, *Introduction to Chemical Principles* (New York: Macmillan Publishing Co., Inc.), 1983, Chapter 14, Section 4.2 "Strengths of Acids and Bases," pp. 376–378.

Donald A. McQuarrie and Peter A. Rock, *General Chemistry, 3rd Ed.* (New York: W. H. Freeman and Company), 1987, Chapter 18 "Acids and Bases," pp. 637–638.

James E. Brady, *General Chemistry, Principles and Structure* (New York; John Wiley & Sons, Inc.), 1990, Chapter 5 "Chemical reactions in Aqueous Solution," pp. 128–129.

M. K. Snyder, *Chemistry, Structures and Reactions*, Holt, Rinehart and Winston, Inc., New York, pp. title page, 544, 739 (1966).

D. M. Muir et al., "Solvent Elution of Gold from C.I.P. Carbon", *Hydrometallurgy*, vol. 14, pp. 47–65, (1985).

F. Espiell et al., "Gold Desorption from Activated Carbon with Dilute NaOH/Organic Solvent Mixtures", *Hydrometallurgy*, vol. 19, pp. 321–333 (1988).

W. T. Yen et al., "Carbon Stripping at Ambient Temperature", *Precious Metals* 1989, Proceeding of the Thirteenth International Precious Metals Institute Conference, International Precious Metals Institute, Allentown, Pa., pp. 261–274 (1989).

"Biochemical and Organic Compounds for Research and Diagnostic Clinical Reagents", 1988 Sigma Chemical Company, pp. 816–823.

*Primary Examiner*—Theodore Morris
*Assistant Examiner*—P. L. Hailey
*Attorney, Agent, or Firm*—Skjerven, Morrill, MacPherson, Franklin & Friel

[57] ABSTRACT

An improved process for stripping gold cyanide from activated carbon is disclosed. The process involves contact of gold-laden activated carbon with a strong base at ambient temperatures followed by elution with an aqueous solution containing an organic solvent, preferably aqueous acetonitrile or methanol. Gold cyanide is separated from the aqueous/organic solution by ion-exchange technology, preferably using a weak base ion-exchange resin, followed by elution with a strong base.

18 Claims, 2 Drawing Sheets

RAPID, AMBIENT-TEMPERATURE PROCESS FOR STRIPPING GOLD BOUND TO ACTIVATED CARBON

BACKGROUND OF THE INVENTION

1. Field of the Invention

This invention relates to stripping gold from activated carbon at ambient temperature by contacting the gold-loaded activated carbon with a strong base and then an organic solvent and subsequently recovering the stripped gold from the solvent using ion exchange technology.

2. Description of Prior Art

In the mining industry, gold ore is most commonly leached with a cyanide solution and the gold is recovered from the cyanide lixiviant by adsorption on activated carbon. The most common commercial techniques for elution of gold cyanide from activated carbon are the Zadra (Zadra et al., U.S. Pat. No. 2,588,450, issued Mar. 11, 1950) and Anglo procedures. (Davidson and Duncanson, "Desorption of Gold from Activated Carbon with Deionized Water," *J. South Afr. Instr. Min. Metall.*, 77(12), pp 254-261, (1977); Davidson and Veronese, "Further Studies on the Elution of Gold from Activated Carbon using Water as the Eluant," *J. South Afr. Instr. Min. Metall.*, 79(1), pp 437-495, (1979).

In the Zadra procedure, hot solutions of 1% weight-/volume (w/v) sodium hydroxide and 0.2% w/v sodium cyanide are recycled through a gold cyanide-loaded activated carbon bed for up to 72 hours at 95°-100° C. to desorb $Au(CN)_2^-$. More recently, a modified Zadra procedure operating at 140° C. in a pressurized system has reduced elution time to 10-12 hours.

In the Anglo elution procedure, gold cyanide-loaded activated carbon is contacted with 5% w/v sodium cyanide and 1% w/v sodium hydroxide followed by elution for 8-12 hours with hot deionized water at 100°-120° C. While both the Zadra and Anglo procedures are effective in stripping gold from activated carbon, those procedures suffer from high energy consumption, high capital costs for pressurized operations, long elution times and the use of high concentrations of sodium cyanide.

Other attempts to strip gold bound to activated carbon have been directed toward development of methods performed at lower temperatures that desorb gold faster than either the Zadra or Anglo elution procedures.

D. M. Muir, W. Hinchliffe, N. Tsuchida and Ruane, M., "Solvent Elution of Gold from C.I.P. Carbon, *Hydrometallurgy* 14, 47-65 (1985) (herein after Muir et al. (1985a)) reported that, in the presence of 10 g/L of sodium cyanide, either 40 percent volume/volume (v/v) aqueous acetone or 40 percent (v/v) aqueous acetonitrile desorbs gold in approximately eight hours at temperatures of 25° to 70° C. However, temperatures between 50° and 70° C. offered much faster and more efficient gold desorption. Muir et al. state that organic solvents by themselves or mixed with water do not desorb gold from activated carbon unless either sodium cyanide is added to the solvent or the gold-loaded activated carbon is soaked with sodium cyanide prior to contact with the solvent.

Muir et al. (1985a) further reported that the activity of the activated carbon for gold loading decreased upon successive gold-loading/stripping cycles (with 40 percent aqueous acetonitrile containing 10 g/L of NaCN) to the point that, after 5 cycles, the relative activity of the activated carbon dropped to about 50 percent of its original value. This is similar to the loss of activated carbon activity observed upon successive loading/stripping cycles using either the Anglo or Zadra elution procedures. Muir et al. (1985a) noted that some of the gold-binding activity of the activated carbon could be restored by a steam treatment, but the activity was not restored to levels of fresh activated carbon. It was also noted that stripping of gold-loaded activated carbon with aqueous acetone containing NaCN produced irreversible loss in activated carbon activity for further gold loading.

Patents have been issued to Parker et al. (A. V. Parker and D. M. Muir, "Composition for Stripping Gold or Silver from Particulate Materials," U.S. Pat. No. 4,427,571 issued Jan. 24, 1984) and to Heinen et al. (H. J. Heinen, D. G. Peterson and R. E. Lindstrom, "Desorption of Gold from Activated Carbon," U.S. Pat. No. 4,208,378 issued Jun. 17, 1980) for stripping gold from activated carbon using either aqueous solutions of nitriles containing sodium cyanide or sodium thiocyanate or aqueous solutions of alcohols containing sodium cyanide or sodium thiocyanate.

D. M. Muir, W. D. Hinchliffe and A. Griffin, "Elution of Gold from Carbon by the Micron Solvent Distillation Procedure," *Hydrometallurgy*, 14, 151-169, (1985) (herein after Muir et al. (1985b)) proposed a gold desorption procedure by pretreatment of gold-laden activated carbon with a solution of sodium cyanide and sodium hydroxide followed by elution with one of methanol, ethanol or acetonitrile vapors and condensate at 65°-80° C. Using this procedure, the gold cyanide was stripped in 4-6 hours. However, activated carbon activity was lost through subsequent gold-loading/-stripping cycles.

F. Espiell, A. Roca, M. Cruells and C. Nuneg, "Gold Desorption from Activated Carbon with dilute NaOH-/Organic Solvent Mixture," *Hydrometallurgy* 19 321-333 (1988) (herein after Espiell et al. (1988)) examined gold desorption from activated carbon using mixtures of NaOH (20 g/L) and 50% aqueous organic solvents at 30° C. The acetone-water-hydroxide system was reportedly most efficient at gold desorption with over 90 percent of the gold being stripped in less than 40 minutes. However, a loss in gold-binding activity was observed over several loading/stripping cycles. This loss in activity was attributed to the inability of the acetone solvent system to strip the gold most strongly adsorbed to the activated carbon.

D. D. Fisher, "Process for Eluting Adsorbed Gold and/or Silver Values from Activated Carbon," U.S. Pat. No. 3,935,006 issued Jan. 27, 1976 asserted that at ambient temperatures, aqueous solutions of water-soluble alcohols containing a strong base such as sodium hydroxide were capable of stripping over 98 percent of the gold adsorbed on activated carbon. In contrast, Espiell et al. (1988) determined that a mixture of a strong base in aqueous methanol is one of the poorest gold eluants for gold-loaded activated carbon. Similarly, Muir et al. (1985b) determined that, at room temperature, aqueous methanol in the presence of sodium cyanide was one of the poorest eluants of gold from activated carbon.

W. T. Yen and R. H. Pinred, "Carbon Stripping at Ambient Temperatures," in *Precious Metals* 1989, Proceeding of the Thirteenth International Precious Metals Institute Conference, International Precious Metals Institute, Allentown, Pa., pp. 261-274 (1989) pre-soaked gold-loaded activated carbon with a solution containing NaCN and NaOH, and then stripped the gold at room temperature by elution with a solution containing NaCN, NaOH and 40% (v/v) acetonitrile. They reported that 98 percent of the gold was stripped from activated carbon in six hours using this method. However, loss of activated carbon activity for gold loading amounted to 31 percent after contact with the caustic cyanide/acetonitrile solution.

Muir et al. (1985b) determined that a 40 percent aqueous solution of either acetone or acetonitrile, which solution contained NaCN and the gold stripped from the activated carbon, could be treated by electrowinning to recover metallic gold. However, the fire hazards of electrowinning caused by the flammable organic solvent and solvent losses due to evaporation required the use of an expensive sealed diaphragm electrowinning cell which contained a membrane to separate the anolyte and catholyte. Although metallic gold could be recovered by electrowinning from the 40 percent acetonitrile solution; temperature, current density and gold concentration were critical in effective, efficient, recovery of gold.

In summary, previous commercial methods devised for stripping dicyanoaurate(I) anions bound to activated carbon have involved: 1) a high temperature/pressure pre-soak of the gold-laden activated carbon with aqueous NaCN/NaOH solutions followed by stripping with hot deionized water; 2) a high temperature pressure strip with aqueous NaCN/NaOH; or 3) organic solvents which contain aqueous NaCN/NaOH. These methods all require the use of NaCN in the stripping process. The previous methods developed for stripping the gold cyanide anion from activated carbon suffer from high energy costs (i.e., stripping at high temperatures), from lengthy stripping times, from the use of high concentrations of environmentally objectionable sodium cyanide, from loss of activated carbon gold-binding activity over successive loading-stripping cycles, or from the fire hazards associated with electrowinning gold cyanide from solutions containing organic solvents. Thus a safe, rapid, ambient temperature process for stripping gold cyanide from activated carbon would be useful for subsequent recovery of metallic gold from aqueous solutions containing $Au(CN)_2^-$:

SUMMARY OF THE INVENTION

According to the method of this invention, gold (as the dicyanoaurate(I) anion) which is bound to activated carbon is quickly stripped from the activated carbon by a two-step process at ambient temperatures. The first step comprises contacting the gold cyanide-loaded activated carbon with a strong base such as sodium hydroxide or potassium hydroxide. The second step comprises contacting the pre-soaked gold-cyanide-loaded activated carbon with an organic solvent, preferably an aqueous organic solvent, most preferably 20 percent (v/v) acetonitrile, which strips the gold cyanide anion from the activated carbon in less than one hour. The gold cyanide anion is then recovered from the organic solvent by contacting the gold cyanide-containing solvent with a weak base anion exchange resin. Thus, the organic solvent is free of gold and may be reused in the stripping process. Gold cyanide is subsequently stripped from the weak base resin by eluting the gold cyanide with a strong base such as an alkali metal hydroxide, e.g., sodium hydroxide. The resultant basic solution contains gold cyanide complex which is free from the organic solvent. Gold can be electroplated from the resultant basic solution free from fire hazards associated with prior art methods.

DETAILED DESCRIPTION

Figure 1:
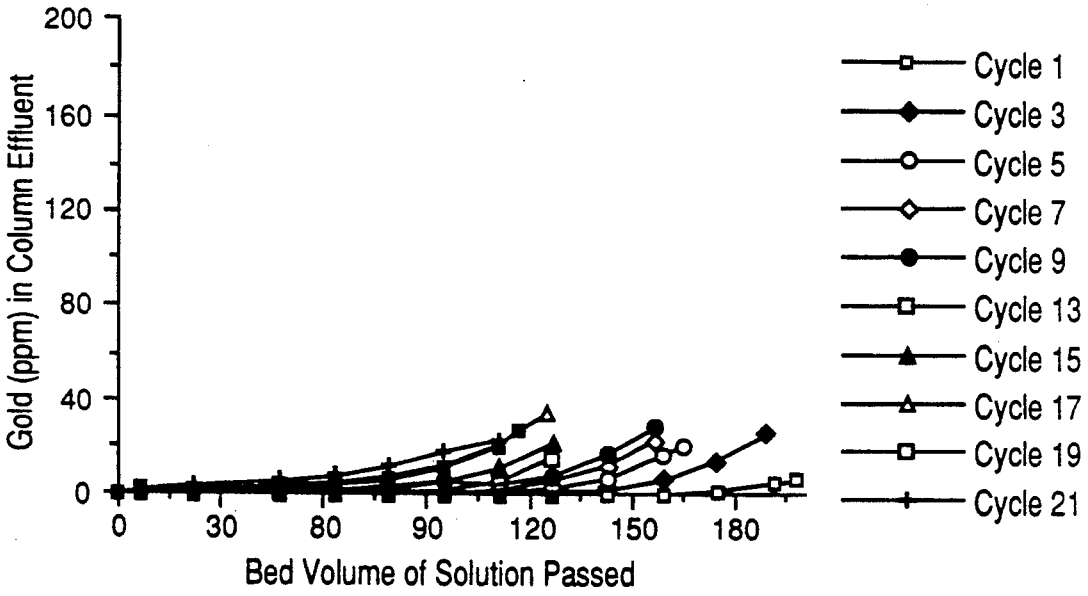
FIG. 1 illustrates breakthrough curves for loading $Au(CN)_2^-$ onto coconut activated carbon. After each loading cycle gold cyanide was stripped using the two-step stripping procedure (pre soaking with KOH followed by aqueous methanol) as described in Example 10.

We have made the surprising discovery that when gold cyanide-loaded activated carbon is pre-soaked with a strong base, preferably an aqueous solution of a strong base, any one of a variety of organic solvents can quantitatively strip the gold from the activated carbon in minutes. This is in contrast to the use of an aqueous organic solvent alone, a strong base alone or a mixture thereof, all of which are much less effective. Furthermore, use of the two-step process of this invention preserves substantially more of the gold-binding activity of the activated carbon than is preserved with the use of base/aqueous solvents in a one-step stripping process.

We have also discovered that adjusting the pH of the gold cyanide-containing, basic organic solvent and contacting the resulting solution with a basic anion exchange resin, preferably a weak base anion exchange resin, results in adsorption of the gold cyanide ion from the organic solvent. The gold cyanide ion is then desorbed from the weak base anion exchange resin using a strong base solution. The organic solvent can be recovered and reused. This recovery process separates the gold cyanide ion from the organic solvent without resort to the use of fire-hazardous, electrowinning methods.

In the gold cyanide-stripping method of this invention, the first step comprises contacting activated carbon-loaded with gold cyanide with a strong base, preferably as an aqueous solution for a predetermined time. A preferred strong base solution is either sodium hydroxide or potassium hydroxide at a concentration of from about 0.1M to about the limit of solubility, preferably about 1.0M to about 5.0M, and most preferably about 2.0M NaOH or about 2.0M KOH. Of course, in view of this disclosure, the use of other strong base solutions will be apparent to those skilled in the art.

The aqueous strong base solution is contacted with the gold cyanide-containing activated carbon for a predetermined time of at least about 5, preferably at least about 10, and most preferably, at least about 15 minutes at room temperature. Use of somewhat higher temperatures decreases the amount of time, and somewhat lower temperatures increases the amount of time required for the pre-soak. While the pre-soak step may be performed at a temperature in the range of 0° to 100° C., i.e., at a temperature where the strong base solution is in a liquid only state, preferably the pre-soak step is performed at a temperature in the range of about 15° to about 30° C., i.e., room temperature, most preferably about 24° C. Fifteen minutes is usually sufficient for the pre-soak at room temperature. While use of longer pre-soak periods is feasible, use of longer periods of time does not improve the quantity of gold ultimately stripped from the activated carbon.

Following the pre-soak step, the aqueous strong base solution is removed, and the gold-laden activated carbon is contacted with a suitable organic solvent solution for a predetermined time sufficient to desorb the gold cyanide anion. Sufficient time varies depending on the temperature, the organic solvent used and whether the contact is performed in a batch or column mode. Usually, from about 15 to about 30 minutes at room temperature is sufficient.

A variety of organic solvents such as nitriles, alcohols and ketones can be used in the process. A preferred nitrile is acetonitrile, preferably aqueous acetonitrile. Preferably, the solution is from about 5 to about 100 percent, more preferably from about 10 to about 40 percent (v/v) acetonitrile. Twenty percent (v/v) aqueous acetonitrile is a most preferred aqueous organic solvent solution for stripping the gold. Other nitriles such as propiononitrile or butyronitrile also strip the bound gold from the pre-soaked gold-laden activated charcoal.

A variety of alcohols are suitable for use in the process of this invention. Preferred alcohols contain from one to four carbon atoms. Either branched chain or straight chain alcohols are effective. Preferably, the alcohol is isopropanol, ethanol or, most preferably, methanol. The alcohols are used as aqueous solution of from about 10 to about 100 percent v/v alcohol.

A ketone is also suitable to strip gold from the activated carbon using the two-step process of this invention. Suitable ketones are branched or straight chain ketones containing 3 to 6 carbon atoms. A preferred ketone is acetone. The acetone is used as an aqueous solution of from about 5 to about 100% (v/v) acetone, preferably 20%.

Of the aqueous organic solvent solutions, acetonitrile is the most effective, and methanol is more effective than ethanol, isopropanol or acetone. Furthermore, use of acetone or isopropanol results in irreversible loss of gold-binding activity by the activated carbon. Of the alcohols tested, methanol is the most effective stripping agent, but the activated carbon slowly loses its gold-binding activity to about 60 percent of its original value over 21 gold-loading/stripping cycles. In contrast, using acetonitrile as the solvent results in very little decrease in gold-loading capacity of the activated carbon over numerous loading-stripping cycles.

Following the stripping step of the present invention, gold cyanide is present in a slightly basic, aqueous organic solvent solution. The precise composition of the solution naturally depends upon solutions used in the pre-soak and stripping steps. The solution is slightly basic because there is at least some carryover of the base from the pre-soak step. Similarly, if pure organic solvents were used in the stripping step, there would be some water carryover from the pre-soak step so that the organic solvent solution containing the gold solvent is aqueous. However, if all carryover was eliminated, the subsequent processing, as described below, would simply be modified as necessary to obtain the conditions described. The gold is recovered from the basic, aqueous organic solvent solution using anion exchange resins. Strong base anion exchange resins usually contain a quaternary amine functional group and operate well in basic solutions. Thus, the gold cyanide anion present in the basic aqueous solution can be recovered by use of a strong base anion exchange resin. However, as is well-known to those skilled in the art, strong base anion resins bind the gold cyanide so strongly that exotic stripping reagents and procedures are required to quantitatively strip the gold from the resin.

In contrast, according to the principles of our invention, weak base anion resins are easily stripped of the gold cyanide anion using a basic solution. Weak base anion exchange resins usually have primary, secondary or tertiary amine functional groups that must be protonated to function. Thus, weak base anion resins cannot be used in basic solutions at a pH much above the $pK_a$ of the amine functional group. Consequently, to recover the gold from the slightly basic aqueous organic solvent solution, the base is neutralized. In one embodiment, the gold-solvent solution is adjusted to a neutral or slightly acidic pH, preferably to a pH in the range of from about 5 to about 7 with a mineral acid such as HCl, $HNO_3$ or $H_2SO_4$. The organic solvent solution is then contacted with a weak base anion exchange resin.

Any weak base anion exchange resin may be used in the recovery of the gold cyanide complex from the pH adjusted aqueous organic solvent solution. However, many weak base anion exchange resins, and particularly those which have a polystyrene backbone, may contain some strong base quaternary ammonium groups that account for as much as 10 to 15% of the resin capacity.

To assure quantitative stripping of the bound gold from the weak base anion exchange resin with a base eluant, a weak base resin with a minimum number of strong base ion exchange groups is preferred. Specifically, a weak base anion exchange resin, which has a minimum number of strong base functional groups, less than five percent of the anion exchange resin capacity, preferably less than one percent of the anion exchange resin capacity, most preferably free from strong base functional groups, is preferred. A weak base resin, which has a minimum amount of strong base functionality, is Duolite A-7 available from Rohm and Haas, Philadelphia, Pa.

If a weak base anion exchange resin has strong base functional groups, the stripping process of this invention will not remove the gold bound to the strong base functional group. Therefore, the recovery is not quantitative until all of the strong base functional groups are saturated. After saturation, the capacity of the resin is obviously reduced, but recovery is quantitative. To ultimately recover the gold bound to the strong base functional groups, the exotic processes referenced above must be used.

Following a time sufficient for adsorption of the gold by the resin, the aqueous, organic solvent solution is removed. The amount of time varies depending on factors such as temperature, gold concentration, and resin type, all of which are known to one skilled in the art of ion exchange chromatography. Typically, a contact time of in the range of about 2 to about 15 minutes, preferably about 6 minutes, at room temperature is a time sufficient for adsorption of the gold by the resin.

The weak base anion exchange resin adsorbs the gold and does not adsorb the organic solvent. Consequently, the organic solvent can be reused in additional stripping cycles. When neutralizing the gold-solvent mixture with a mineral acid, salts such as $Na_2SO_4$, NaCl, $NaNO_3$(or potassium salts if KOH is used in the activated carbon pre-soak step) may build-up in the aqueous organic solvent. These salts can be removed using standard deionization ion-exchange resins which are well known to one skilled in the art. This removal of salts facilitates continued use of the solvent in subsequent gold stripping methods.

The gold cyanide ions which have been adsorbed on the weak base ion-exchange resin are then desorbed from the resin using a strong base. Suitable base are those that produce hydroxide ions in aqueous solutions, such as KOH or NaOH, at concentrations of from about 0.1 to about 1.0M, preferably about 0.5M. The strong base solution is contacted with the resin for a time sufficient to desorb the gold cyanide anions. The gold cyanide anions are quickly stripped at room temperature from the resin using a contact time in the range of about 2 to about 24 minutes, preferably about six minutes, e.g., a flow rate of 10 bed volumes per hour through a column containing the gold-laden weak base ion-exchange resin.

The strong base solution is separated from the resin and gold cyanide anions are recovered in an aqueous, strong base solution. This solution can be treated by zinc cementation or electrowinning using techniques well known to one skilled in the art to recover metallic gold. Any danger of fire hazards of prior art methods is no longer present, since the solution no longer contains an organic solvent.

Both the stripping method and the recovery method of this invention can be practiced in either a batch mode or a column mode. In the batch process stripping method, gold-laden activated carbon is placed in a vessel and contacted with the aqueous strong base solution. After a sufficient pre-soak time period, usually about 15 minutes, the aqueous base solution is removed from the vessel. The base solution can be used for additional stripping procedures later.

The pre-soaked gold-laden activated carbon in the vessel is then contacted with the organic solvent solution, preferably an aqueous organic solvent solution, for a predetermined period of time sufficient to elute the gold cyanide ion, usually at least about 15 minutes or more. After the predetermined time period, the aqueous organic solvent solution containing stripped $Au(CN)_2^-$ is removed from the vessel.

After pH adjustment to pH 7 or below, the dicyanoaurate(I) anions in the aqueous organic solvent solution are then preferably adsorbed on a weak base anion exchange resin in a second vessel containing the resin. Alternatively, the pre-soak and stripping may be performed in the batch method, and the recovery performed using a column method, described more completely below. After a sufficient period of time, as described above, to allow adsorption of the gold complex to the resin, the gold-free organic solvent solution is pumped or drained from the vessel for subsequent reuse.

Gold cyanide anions are desorbed from the resin in the batch mode by contact with a strong base for a sufficient period of time, as previously described. Thereafter, the gold-laden base solution is pumped or drained from the vessel and the metallic gold recovered as described above.

In the column mode, gold-laden activated carbon is placed into a column through which fluids can pass. One bed volume of the aqueous strong base solution is passed into the column for a sufficient period of time for the pre-soak preferably, about 15 minutes. Then the aqueous organic solvent is pumped into the column at a flow rate of from about 1/12 to about 1 bed volumes per minute and simultaneously the strong base solution is flushed from the column. Faster flow rates result in larger volumes of more dilute gold-containing solutions than do slower flow rates. Flow rates of from about 1/6 to about ⅓ bed volumes per minute are preferable, since gold concentrations of thousands of parts per million are achieved in less than one hour. Most of the gold is recovered in the first 2-3 bed volumes of the organic solvent solution eluant.

The organic solvent solution eluant, now containing the gold stripped from the activated carbon as the $Au(CN)_2^-$ ion, is passed through a second column preferably containing a weak base anion exchange resin. Flow rates through the resin can vary from about 1/12 to about 12 bed volumes per minutes. Most effective gold adsorption onto the resin is observed at flow rates of from about 1/6 to about ⅓ of a bed volume per minute. The organic solvent which exits the column is now free of gold and can be recycled for additional gold stripping from the activated carbon as described above. The gold adsorbed on the anion exchange resin is stripped by the passage of a strong base such as sodium hydroxide or potassium hydroxide, in the concentration described above, through the column at flow rates of from about 1/12 to about 1 bed volume per minute, but preferably at from about 1/6 to about ⅓ bed volume per minute producing a solution containing the maximum concentration of the gold anion.

While either batch or column modes can be used to practice this invention, column methods result in the best gold recovery and are preferred. The principles of this invention are further illustrated by the following examples.

EXAMPLE 1

This example illustrates an exemplary stripping method of this invention which is practiced in a batch mode and uses aqueous acetonitrile as the aqueous organic solvent solution.

Five mL of a potassium dicyanoaurate(I) solution at pH 3 containing 120 ppm ($6.1\times10^{-4}$M) of gold was pipetted into test tubes containing 0.10 g of activated coconut carbon (10-20 mesh, West States Carbon, Los Angeles, Calif.). The test tubes were agitated for 15 minutes and then the supernatants were each analyzed for gold by atomic absorption spectrophotometry to ascertain how much gold was adsorbed to the activated carbon.

The supernatant was poured off and subsequently 5.0 mL of 1.0M NaOH was added to each tube containing the gold-laden activated carbon. The tubes were agitated for 15 minutes, the NaOH solution was poured off, and then 5.0 mL of aqueous solutions containing various volume percentages of acetonitrile were added to each tube. After agitation for 15 minutes, the supernatant solutions were analyzed for gold which had been stripped from the activated carbon.

All experiments were done at ambient temperatures of 24° C. Before performing the next gold-binding stripping cycle (as described above), the acetonitrile-containing solutions were poured off of the activated carbon in each tube, and the activated carbon was washed with 5 mL of distilled water for 15 minutes. Table 1 shows results of gold elution with varying acetonitrile concentrations for three loading/stripping cycles.

TABLE 1

| Effluent (%, v/v) | Gold Elution, Percent | | |
|---|---|---|---|
| | Cycle 1 | Cycle 2 | Cycle 3 |
| 40% Acetonitrile | 99 | 100 | 102 |
| 20% Acetonitrile | 88 | 94 | 92 |
| 10% Acetonitrile | 65 | 73 | 75 |
| 5% Acetonitrile | 58 | 60 | 62 |
| 2% Acetonitrile | 34 | 42 | 45 |

All gold bound to the activated carbon was recovered with the 40 percent (v/v) acetonitrile, and good recovery was obtained with the 20 percent acetonitrile solution. Essentially no gold was recovered in the sodium hydroxide solution after the pre-soaking step.

The above described procedure was repeated ten times. Each time gold-laden activated carbon was pretreated for 15 minutes with 2.0M KOH or NaOH and then eluted for 15 minutes with 20 percent acetonitrile. The results demonstrated that quantitative recovery of gold from the activated carbon was achieved.

EXAMPLE 2

This example shows that using a one-step elution process wherein the sodium hydroxide and acetonitrile are mixed together, stripping effectiveness is considerably diminished over the two-step stripping process.

The experimental procedure for loading the activated carbon with gold cyanide was performed as described in Example 1, but the 1M NaOH pre-soaking step was eliminated and acetonitrile solutions containing sodium hydroxide were used as the stripping reagent in a one-step elution.

Table 2 shows results of three loading/stripping cycles.

TABLE 2

| Eluant | Gold elution, Percent | | |
|---|---|---|---|
| | Cycle 1 | Cycle 2 | Cycle 3 |
| 40% acetonitrile in 1.0M NaOH | 40 | 59 | 58 |
| 40% acetonitrile in 0.25M NaOH | 19 | 55 | 62 |
| 20% acetonitrile in 0.25M NaOH | 8 | 40 | 52 |
| 10% acetonitrile in 0.25M NaOH | 11 | 36 | 40 |
| 5% acetonitrile in 0.25M NaOH | 14 | 33 | 33 |
| 2% acetonitrile in 0.25M NaOH | 11 | 20 | 20 |
| 40% acetonitrile without NaOH | 8 | 20 | 30 |

Whereas 90–100 percent of the gold was stripped using the two-step procedure in Example 1 with 20 to 40 percent acetonitrile, this example shows that only 50–60 percent of the gold is stripped from the activated carbon when the sodium hydroxide is incorporated into the acetonitrile. Higher concentrations of sodium hydroxide, as high as 2.0M, were tested, but gold elution did not improve significantly. In addition, high concentrations of NaOH cause the separation of aqueous acetonitrile into two layers.

EXAMPLE 3

This example describes the results using the two-step stripping process of this invention in a column mode over 16 loading and stripping cycles. A gold-loaded activated carbon column was prepared by transferring activated carbon (10–20 mesh, West States Carbon) into a 1.0 cm (internal diameter) glass column to obtain a activated carbon bed volume of 9.0 mL. A solution of potassium dicyanoaurate(I) at pH 5.0 containing approximately 200 ppm (1×10phu p31 3M) of gold was pumped through the column at a flow rate of 10 bed volumes per hour. Fractions of column effluents from the column were collected and analyzed for gold. After passing 111 bed volumes (or 1.0 L) of gold solution through the column, the gold-laden activated carbon was stripped at 24° C. as follows.

One bed volume of 2.0M KOH was pumped into the column and allowed to remain in contact with the gold-laden activated carbon for 15 minutes. Then, 10 bed volumes of 20 percent (v/v) aqueous acetonitrile were passed through the column at a flow rate of 10 bed volumes per hour. Fractions of the aqueous acetonitrile effluent were collected and analyzed for gold. After passage of the acetonitrile solution, the column was washed with 10 bed volumes of deionized water and the loading/stripping cycle was repeated. A total of sixteen loading/stripping cycles were performed with a wash cycle between each of the loading/stripping cycles.

Negligible amounts of gold were found in any of the one bed volume fractions of KOH. All experiments were done at 24° C. Table 3 shows results of repeated gold loading and stripping.

TABLE 3

| Loading/ Stripping Cycle Number | Influent Gold Loading Concentration (ppm) | Total Gold Loaded (mg) | Total Gold Stripped from Carbon (mg) | Percent Recovery |
|---|---|---|---|---|
| 1 | 196 | 195 | 197 | 101 |
| 2 | 196 | 195 | 197 | 99 |
| 3 | 198 | 196 | 189 | 96 |
| 4 | 198 | 197 | 195 | 99 |
| 5 | 198 | 196 | 191 | 97 |
| 6 | 198 | 196 | 194 | 99 |
| 7 | 198 | 196 | 189 | 97 |
| 8 | 202 | 199 | 205 | 103 |
| 9 | 204 | 201 | 201 | 100 |
| 10 | 211 | 208 | 211 | 101 |
| 11 | 211 | 209 | 211 | 101 |
| 12 | 208 | 205 | 205 | 100 |
| 13 | 209 | 207 | 208 | 101 |
| 14 | 207 | 204 | 203 | 99 |
| 15 | 210 | 206 | 208 | 101 |
| 16 | 205 | 201 | 195 | 97 |

Table 3 shows essentially quantitative (within experimental error) recovery of gold from the gold-loaded activated carbon over the sixteen gold-loading/stripping cycles. Furthermore, there was no loss in capacity of the activated carbon for gold loading throughout the 16 cycle loading sequence.

EXAMPLE 4

This example shows gold loading onto activated carbon, stripping of gold with the two-step process (2.0M KOH followed by 20 percent acetonitrile) and subsequent separation and recovery of gold from the aqueous acetonitrile solution with an ion-exchange resin. All experiments were done at 24° C.

An activated coconut carbon column was prepared by transferring activated carbon (12–30 mesh size West States Carbon, Los Angeles Calif.) previously washed with 0.1M HCl into a 0.7 cm (internal diameter) glass column to obtain a activated carbon bed volume of 5 mL. A potassium dicyanoaurate(I) solution at pH 5.0 containing 203 ppm ($1\times10^{-3}$M) of gold was then pumped through the column at a flow rate of 20 bed volumes per hour. Fractions of column effluents were collected and were analyzed for gold. Table 4 shows the gold concentration of various column effluents.

TABLE 4

| Bed Volumes Passed | Gold Concentration in Effluent (ppm) |
|---|---|
| 4 | 0.02 |
| 32 | 0.03 |
| 64 | 0.12 |
| 96 | 0.70 |
| 124 | 2.32 |

The gold loaded onto activated carbon in this example was stripped by contacting the activated carbon with one bed volume of 2.0M KOH for 15 minutes and then passing 10 bed volumes of a 20% (v/v) acetonitrile aqueous solution through the column at a flow rate of 10 bed volumes per hour. One bed volume eluate fractions were collected and analyzed for gold using flame atomic absorption spectrophotometry. Results of these analyses are shown in Table 5.

TABLE 5

| Eluate Fraction Number | Gold Concentration (ppm) in Each Fraction |
|---|---|
| 1 | 1.0 |
| 2 | 7800 |
| 3 | 7100 |
| 4 | 3940 |
| 5 | 2360 |
| 6 | 1700 |
| 7 | 889 |
| 8 | 512 |
| 9 | 323 |
| 10 | 189 |
| 11 | 126 |

Eluate fraction number 1 contained the 2.0M KOH solution used to pre-soak the gold-laden activated carbon. Fractions 2–22 comprise the 20 percent acetonitrile strip solution. Mass balance calculations showed that 99.3% of the loaded gold was recovered in the acetonitrile strip fractions. Fractions 2 through 11 were combined and used to demonstrate separation of gold from the organic stripping reagent with a weak base anion exchange resin as described below.

A weak base anion exchange resin (Duolite A-7, Rohm and Haas, Philadelphia, Pa.) was transferred into a 0.7 cm (internal diameter) glass column to obtain a resin bed volume of 5 mL. The resin was preconditioned by pumping ten bed volumes of deionized water, then one bed volume of 0.1M $H_2SO_4$, and finally ten bed volumes of distilled water through the column at a flow rate of 10 bed volumes per hour. Combined fractions 2–11 of the 20 percent acetonitrile stripping solution containing 2433 ppm of gold were adjusted to pH 5.0 by addition of 1.0M sulfuric acid, and were pumped through the column at a flow rate of 10 bed volumes per hour. One bed volume fractions of column effluent were collected and analyzed for gold (Table 6).

TABLE 6

| Eluate Fraction Number | Gold Concentration (ppm) in Each Fraction |
|---|---|
| 1 | 0.02 |
| 2 | 0.02 |
| 3 | 0.00 |
| 4 | 0.07 |
| 5 | 0.08 |
| 6 | 0.09 |
| 7 | 0.11 |
| 8 | 0.17 |
| 9 | 1.69 |
| 10 | 87.0 |

TABLE 6-continued

| Eluate Fraction Number | Gold Concentration (ppm) in Each Fraction |
|---|---|
| 11 | 502 |

The resin capacity for gold began to be exceeded after passage of 9 bed volumes of the gold solution through the column. The leakage of gold can be alleviated by using a larger volume of resin than was used in this example.

Gas chromatographic analysis of column effluents showed no diminution of acetonitrile concentrations compared to that of the influent which demonstrates that the acetonitrile concentration of the organic solvent solution is not changed by passage through the column.

The gold bound to the A-7 resin was stripped by passage of 10 bed volumes of a 0.5M KOH solution through the column at a flow rate of 10 bed volumes per hour. Prior to stripping, the column was rinsed with six bed volumes of deionized water to assure that all the acetonitrile was washed out of the column. Table 7 shows stripping results.

TABLE 7

| Eluate Fraction Number | Gold Concentration (ppm) in Each Fraction |
|---|---|
| 1 | 243 |
| 2 | 13,640 |
| 3 | 4940 |
| 4 | 2240 |
| 5 | 1120 |
| 6 | 580 |
| 7 | 137 |
| 8 | 49 |
| 9 | 35 |
| 10 | 31 |

Gas chromatographic analysis of acetonitrile showed the absence of detectable acetonitrile in fractions 1–10.

Mass balance calculation showed that 97 percent of the gold bound by the resin was recovered by the 0.5M KOH strip. Thus a complete separation of the stripping solvent from the gold was achieved.

EXAMPLE 5

Examples 1, 3 and 4 demonstrated the efficacy of the two-step stripping procedure of this invention when $Au(CN)_2^-$ was loaded on activated carbon at acidic pH values. This example demonstrates that the procedure is equally effective when $Au(CN)_2^-$ is loaded onto activated carbon at high pH in the presence of free cyanide.

Activated carbon was prepared as described in Example 4, and 9 mL of activated carbon was charged into a 1.0 cm internal diameter glass column. A solution containing 42.4 ppm ($2.1\times10^{-4}$M) of gold as $Au(CN)_2^-$ at pH 10.1 and also containing 1927 ppm ($7.4\times10^{-2}$M) of cyanide as sodium cyanide was pumped through the column at a flow rate of 10 bed volumes per hour. Once 111 bed volumes (1.0 L) of the solution had passed through the column, the stripping procedure was performed as described in Example 3.Mass balance calculations showed that 42.2 mg of gold were bound to the activated carbon and that 42.0 mg of gold, corresponding to 99.5% recovery of gold from the activated carbon, were recovered by the two-step stripping process of this invention.

EXAMPLE 6

Examples 1, 3–5 showed the effectiveness of the two-step stripping procedure using acetonitrile as a solvent. This example illustrates the two-step stripping process using aqueous isopropyl alcohol as a stripping agent at 24° C.

Five mL of a solution of potassium dicyanoaurate(I) containing 200 ppm ($1\times10^{-2}$M) of gold at pH 4.7 were pipetted into test tubes each of which contained 0.1 g of activated coconut carbon. The activated carbon (12–30 mesh, West States Carbon, Los Angeles, Calif.) was previously treated with 0.1M HCl and then water washed. The tubes were agitated for 15 minutes and supernatants were analyzed for remaining gold.

Subsequently, 5 mL of 2M KOH were pipetted into the activated carbon-containing tubes, and the tubes were then shaken for 15 minutes. Upon removing the KOH, 5 mL of aqueous isopropyl alcohol solutions, varying from 10 to 60% in alcohol concentration and at ambient temperature (24° C.), were pipetted into the tubes. The tubes were then agitated for 15 minutes after which the alcoholic stripping solution was poured off of the activated carbon and analyzed for gold.

Before performing the next gold-loading/stripping cycle, the activated carbon-containing tubes were washed with 5 mL of deionized water for 15 minutes as described above. Table 8 shows the results of elution with varying aqueous isopropyl alcohol concentrations for three loading/stripping cycles.

TABLE 8

| | Gold Elution, Percent | | |
|---|---|---|---|
| Eluant (% v/v) | Cycle 1 | Cycle 2 | Cycle 3 |
| 60% isopropyl alcohol | 73 | 103 | 103 |
| 40% isopropyl alcohol | 69 | 95 | 87 |
| 20% isopropyl alcohol | 63 | 94 | 76 |
| 10% isopropyl alcohol | 43 | 74 | 68 |

In the first cycle, from 43 to 73% of the gold was recovered. However, in the second and third cycle, a substantial improvement in stripping was noted, and the 60% solvent recovered all of the gold. Even though gold recovery was complete in the second and third stripping cycles with 60% isopropanol, the amount of gold loaded on the activated carbon in the third loading cycle decreased by 32 percent over that loaded in the first cycle. Thus, use of aqueous isopropyl alcohol leads to a decrease in capacity of the activated carbon for gold in subsequent gold-loading procedures.

Table 9 shows that various concentrations of isopropanol with or without sodium hydroxide used in a one step stripping process as described in Example 2 are significantly less effective than the two-step stripping process of this invention as shown in Table 8.

TABLE 9

| | Gold Elution, Percent | | |
|---|---|---|---|
| Eluant (% v/v) | Cycle 1 | Cycle 2 | Cycle 3 |
| 100% isopropanol | 1.8 | 2.2 | — |
| 60% isopropanol | 1.5 | 2.8 | — |
| 40% isopropanol | 0.9 | 2.7 | — |
| 20% isopropanol | 0.2 | 1.3 | — |
| 10% isopropanol | 0.1 | 0.7 | — |
| 20% isopropanol in 2.0M KOH | 58 | 89 | 101 |
| 20% isopropanol in 1.0M KOH | 47 | 75 | 89 |
| 20% isopropanol in 0.5M KOH | 37 | 67 | 81 |

TABLE 9-continued

| | Gold Elution, Percent | | |
|---|---|---|---|
| Eluant (% v/v) | Cycle 1 | Cycle 2 | Cycle 3 |
| 20% isopropanol in 0.2M KOH | 20 | 60 | 69 |
| 20% isopropanol in 0.1M KOH | 14 | 66 | 39 |

Furthermore, the one-step stripping process using a solvent of 20 percent isopropanol combined with 2.0M KOH resulted in a 62 percent decrease in the amount of gold loaded on the activated carbon in cycle 3. Thus, the one-step process resulted in a more rapid decrease in gold-loading capacity of the activated carbon than does the two-step procedure.

EXAMPLE 7

This example illustrates the use of ethanol as a stripping agent in the stripping method of this invention.

The two-step stripping process was performed as described in Example 6 with the exception that ethanol was used instead of isopropanol. Table 10 illustrates the results.

TABLE 10

| | Gold Elution, Percent | | |
|---|---|---|---|
| Eluant (% v/v) | Cycle 1 | Cycle 2 | Cycle 3 |
| 100% ethanol | 71 | 86 | 80 |
| 60% ethanol | 71 | 89 | 72 |
| 20% ethanol | 35 | 56 | 58 |

The ethanol solutions stripped from 35 to 89% of the gold using the two-step process. However, the activated carbon lost 26 percent of its gold-loading capacity in cycle 3. Thus, ethanol is not as effective as acetonitrile as a stripping agent.

EXAMPLE 8

This example illustrates the use of acetone as a stripping agent in the two-step stripping process.

The procedure was performed as described in Example 6, but the aqueous organic solvent solution was either 10%, 20%, 40% or 60% acetone aqueous solution. Table 11 shows the results of elution in three cycles.

TABLE 11

| | Gold Elution, Percent | | |
|---|---|---|---|
| Eluant (% v/v) | Cycle 1 | Cycle 2 | Cycle 3 |
| 60% acetone | 94 | 90 | 102 |
| 40% acetone | 87 | 94 | 97 |
| 20% acetone | 72 | 99 | 97 |
| 10% acetone | 59 | 87 | 86 |

The data demonstrate that the 40%, the 60% and even the 20% acetone aqueous solutions are effective gold-eluting agents when the 2M KOH gold-laden activated carbon pre-soaking method is used. However, the acetone inhibits the subsequent activated carbon gold-binding capacity. For example, the 60% acetone aqueous solution produced a reduction of 54% in the capacity of the activated carbon to bind gold only after two loading-binding cycles.

EXAMPLE 9

This example describes the desorption of gold from activated carbon using the two-step batch process (contact with base and then contact with organic solvent solution) using aqueous methanol as the aqueous organic solvent solution.

The experimental procedure followed in this example was as described in Example 6, but the aqueous organic solvent solution was either 10%, 20%, 40% or 60% methanol aqueous solutions. Table 12 illustrates the results of elution in three cycles by the methanol solutions.

TABLE 12

| Eluant (% v/v) | Gold Elution, Percent | | |
|---|---|---|---|
| | Cycle 1 | Cycle 2 | Cycle 3 |
| 60% methanol | 50 | 70 | 81 |
| 40% methanol | 39 | 62 | 71 |
| 20% methanol | 22 | 42 | 51 |
| 10% methanol | 11 | 25 | 33 |

The data demonstrate that the 60% methanol solution functions as a gold stripping agent under these conditions when the KOH activated carbon pre-soaking method is used. The methanol solutions did not inhibit the ability of the activated carbon to bind gold in subsequent cycles. For example, only a 0.6% decrease in the capacity was observed after two cycles.

Experiments were performed to evaluate the gold stripping properties of the methanol solutions when they are mixed with varying KOH concentrations in a one-step elution procedure.

The experimental procedure was as described above for methanol except that the aqueous organic solvent solution was a 60% methanol aqueous solution mixed with either 0.1 M, 0.5M, 1.0M or 2.0M KOH, and the pre-soak step was omitted. In addition, the 60% methanol aqueous solution without base was tested. Table 13 shows the results of elution in three cycles by the 60% methanol-KOH solutions.

TABLE 13

| Eluant (% v/v) | Gold Elution, Percent | | |
|---|---|---|---|
| | Cycle 1 | Cycle 2 | Cycle 3 |
| 60% methanol in 2M KOH | 60 | 71 | 72 |
| 60% methanol in 1M KOH | 59 | 68 | 73 |
| 60% methanol in 0.5M KOH | 55 | 70 | 70 |
| 60% methanol in 0.1M KOH | 39 | 70 | 73 |
| 60% methanol without KOH | 2 | 9 | 18 |

The 60% methanol solution by itself does not desorb the gold bound to activated carbon. The results indicate that as the amount of KOH increased, the percent recovery of gold also increases. As described above, the two-step method using a KOH pre-soak step followed by methanol elution does not result in a significant decrease in the gold-binding capacity of the activated carbon. In contrast, when the gold is stripped with 60% methanol mixed with 2M KOH, different results are obtained. Specifically, increased gold removal is achieved, but the gold-binding ability of the activated carbon upon reuse is reduced. After performing two binding cycles the 60% methanol and 2M KOH solution produced a 13% reduction in the gold-binding ability of the activated carbon.

EXAMPLE 10

Since the two-step batch stripping process with methanol showed little decrease in activated carbon gold-binding capacity in subsequent gold-loading cycles, use of aqueous methanol in a column method was performed.

An activated coconut carbon (West States Carbon, Los Angeles, Calif. 12-30 mesh) was prepared by transferring activated carbon (previously washed with 0.1M HCl and then with water) into a 0.7 cm (internal diameter) glass column to obtain an activated carbon bed volume of 5 mL. A gold cyanide-containing solution (approximately 200 ppm ($1\times10^{-3}$M) in gold) at pH 5.0 was pumped through the column at a flow rate of 10 bed volumes per hour until gold began to appear in column effluent. Analysis of column effluents is shown in Table 14.

TABLE 14

| Bed Volumes Passed | Gold Concentration (ppm) in Effluent |
|---|---|
| 7 | 0.05 |
| 39 | 0.05 |
| 79 | 0.03 |
| 103 | 0.03 |
| 135 | 0.11 |
| 167 | 0.90 |
| 197 | 6.5 |

The gold bound to activated carbon was eluted at 24° C. by contacting the activated carbon with one bed volume of 2M KOH for 15 minutes and subsequently passing ten bed volumes of a 60% methanol aqueous solution through the column at a flow rate of four bed volumes per hour. One bed volume eluates were collected and analyzed for gold. Results are displayed in Table 15.

TABLE 15

| Eluate Fraction Number | Gold Concentration ppm in Each Fraction |
|---|---|
| 1 | 4.0 |
| 2 | 8740.0 |
| 3 | 12420.0 |
| 4 | 6070.0 |
| 5 | 3770.0 |
| 6 | 2310.0 |
| 7 | 1450.0 |
| 8 | 1070.0 |
| 9 | 662.0 |
| 10 | 482.0 |
| 11 | 239.0 |

As in previous examples, the 2.0M KOH (eluate fraction 1) desorbed no significant amount of gold. The 60% methanol aqueous solution (eluates 2-11) removed 95.9% of the bound gold.

After the gold was stripped with the aqueous methanol solution, the column was washed with 10 bed volumes of deionized water. The column was then loaded and stripped of gold (using the 60% methanol with 2.0M KOH pre-soak) as described above over 21 loading/stripping cycles. In every cycle, the efficiency of gold recovery in the methanol stripping solution was better than 95 percent. However, in contrast to the batch studies (Example 9) in the column studies, when gold more fully saturated the activated carbon, a gradual diminution in gold-binding capacity occurred. FIG. 1 shows breakthrough curves for the gold loading over the 21 loading cycles. There is a gradual decrease in gold loading. However, even after 21 loading cycles 95 percent of the gold was recovered through passage of 90 bed volumes of the gold-containing solution through the column.

EXAMPLE 11

This example illustrates that when the aqueous methanol and base (sodium hydroxide) are mixed together and used to strip gold-laden activated carbon, the capacity of the activated carbon for subsequent gold loading is markedly decreased.

Figure 2:
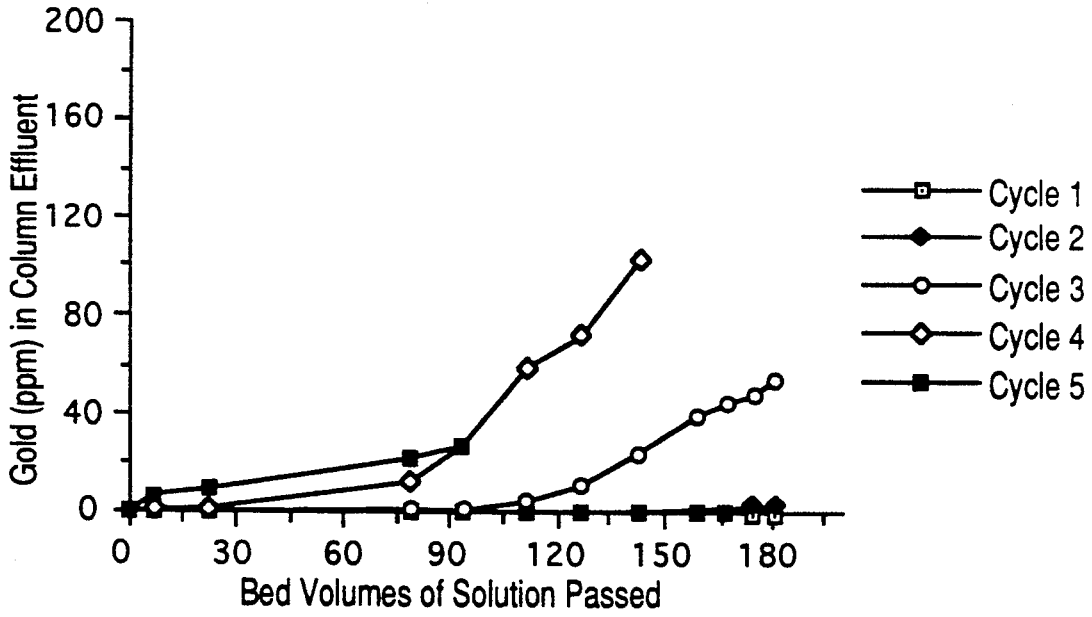
FIG. 2 illustrates breakthrough curves for loading $Au(CN)_2^-$ onto coconut activated carbon. After each loading cycle gold cyanide was stripped using a one step stripping procedure with a combined NaOH and aqueous methanol eluant as described in Example 11.

Activated carbon was prepared as described in Example 10. A potassium dicyanoaurate(I) solution at pH 5 containing 220 ppm ($1.1\times10^{-3}$M) of gold was pumped through the column at a flow rate of 10 bed volumes per hour until gold breakthrough. Column effluents were collected and were analyzed for gold. The bound gold was eluted as described by Fischer in U.S. Pat. No. 3,935,006 that is, by using a solution consisting of 10% water, 90% methanol containing 1 gram/liter of sodium hydroxide (0.02M). Upon stripping, the column was rinsed by passing ten bed volumes of distilled/deionized water. Five loading/stripping cycles were performed as described above, but cycles 4 and 5 were stripped by using a solution of 10% water and 90% methanol containing 4 gram/liter of NaOH (instead of 1 gram/liter). FIG. 2 shows gold concentration in effluents plotted as a function of the number of bed volumes passed through the column over five loading/stripping cycles.

The results show that there is a drastic decrease in the gold-binding ability of the activated carbon after each gold-loading/stripping cycle. It is noted that these results differ from those reported in the patent, but the results are in agreement with Espiell (1988). In addition, the gold stripped by the eluant consisting of 90% methanol aqueous solution in 0.02M NaOH was 89%, 80% and 83% in cycle 1, 2 and 3 respectively. Furthermore, the eluants from gold stripping are not concentrated in 4-5 bed volumes, but in fact are spread out over the entire 10 bed volumes of eluant. For example, Table 16 shows the results from the stripping from cycle 3 in which one bed volume fractions were collected and analyzed for gold.

TABLE 16

| Eluate Fraction Number | Gold Concentration, ppm in Each Fraction |
|---|---|
| 1 | 2600 |
| 2 | 5010 |
| 3 | 4010 |
| 4 | 3750 |
| 5 | 3750 |
| 6 | 3450 |
| 7 | 3200 |
| 8 | 3000 |
| 9 | 2290 |
| 10 | 2250 |
| 11 | 2010 |

Compared to the two-step stripping process in Example 10, Table 15, illustrating a one-step strip process, is much less effective in both stripping and subsequent performance of activated carbon in gold-loading capacity.

EXAMPLE 12

The previous examples illustrated the two-step stripping procedure from gold loaded onto coconut activated carbon supplied by West States Carbon, Los Angeles, Calif. This example demonstrates that the two-step procedure is not dependent on the source of the activated carbon. Coconut activated carbon, supplied by another vendor, Calgon Carbon Corporation, Pittsburgh, Pa., was used in this study.

Activated carbon from Calgon (GRC 22, 8×16) was prepared as described in Example 10. A gold cyanide solution at pH 5 and containing 206 ppm of gold was pumped through a column at a flow rate of twenty bed volumes per minute until 124 bed volumes had been passed. Column effluents were analyzed for gold to determine the quantity of gold bound to the activated carbon.

The gold-laden column was treated by passing one bed volume of 2.0M KOH into the column and allowing a 15 minute contact time after which 10 bed volumes of 20 percent (v/v) aqueous acetonitrile was passed through the column at a flow rate of 10 bed volumes per hour. One bed volume fractions were collected and analyzed for gold. Results shown in Table 17 indicate that the two-step stripping procedure works well with this activated carbon since the majority of the gold was stripped in 4-5 bed volumes.

TABLE 17

| Eluate Fraction Number | Gold Concentration (ppm) in Each Fraction |
|---|---|
| 1 | 1 |
| 2 | 920 |
| 3 | 6640 |
| 4 | 6120 |
| 5 | 3880 |
| 6 | 2760 |
| 7 | 1820 |
| 8 | 1180 |
| 9 | 776 |
| 10 | 563 |
| 11 | 403 |

We claim:

1. A method for stripping activated carbon-bound gold cyanide comprising, in the following order:
   a. contacting the activated carbon-bound gold cyanide with a strong base solution;
   b. removing the strong base solution; and
   c. contacting the activated carbon-bound gold cyanide with an organic solvent selected from the group consisting of acetonitrile, alcohols having from one to four carbon atoms, and ketones having from three to six carbon atoms to remove the bound gold cyanide from the activated carbon.

2. The method of claim 1 wherein said solution comprising a strong base is from 0.1 to 5.0M NaOH or from 0.1 to 5.0M KOH.

3. The method of claim 2 wherein said solution comprising a strong base is 2.0M NaOH or 2.0M KOH.

4. The method of claim 1 wherein said organic solvent is from 5 to 100% (v/v) acetonitrile.

5. The method of claim 1 wherein said organic solvent is from 10 to 100% (v/v) methanol.

6. The method of claim 1 wherein said organic solvent is from 5 to 100% (v/v) acetone.

7. The method of claim 1 wherein step (c) is performed by placing the activated carbon-bound gold cyanide in a column and eluting the gold cyanide with the organic solvent.

8. A method for stripping activated carbon-bound gold cyanide comprising:
   a. contacting the activated carbon-bound gold cyanide with an aqueous solution of from 0.1 to 5M NaOH or from 0.1 to 5M KOH for at least about 15 minutes;
   b. removing the aqueous solution; and c. contacting the activated carbon-bound gold cyanide with from 5 to 100% percent (v/v) aqueous acetonitrile to remove gold cyanide from the activated carbon.

9. A method for recovering gold cyanide from a gold cyanide-containing basic, aqueous solution of an organic solvent comprising, in the following order:

a. adjusting the pH of the gold cyanide-containing basic, aqueous, organic solvent solution to from about 5.0 to about 7.0;

b. contacting the aqueous organic solvent solution with a weak base anion exchange resin to adsorb gold cyanide;

c. removing the aqueous organic solvent solution;

d. contacting the weak base anion exchange resin with strong base solution to desorb gold cyanide; and e. removing the strong base solution, whereby gold cyanide is recovered in the strong base solution.

10. The method of claim 9 wherein the weak base anion exchange resin is a resin having less than 5% of the resin capacity associated with strong base functional groups.

11. The method of claim 10 wherein the weak base anion exchange resin is a resin having less than 1% of the resin capacity associated with strong base functional groups.

12. The method of claim 9 wherein the strong base solution is from about 0.1 to about 1.0M NaOH or from about 0.1 to about 1.0M KOH.

13. The method of claim 12 wherein the strong base solution is about 0.5M NaOH or about 0.5M KOH.

14. The method of claim 9 wherein step (b) is performed by placing the weak base anion exchange resin in a column and passing the aqueous organic solvent solution through said column.

15. The method of claim 9 wherein step (d) is performed with the weak base anion exchange resin in a column and the aqueous strong base solution is passed through said column.

16. A method for recovering gold cyanide from a gold cyanide-containing basic, aqueous solution of an organic solvent comprising, in the following order:

a. adjusting the pH of the gold cyanide-containing basic, aqueous organic solvent solution to from about 5.0 to about 7.0;

b. contacting the aqueous organic solvent solution with a weak base anion exchange resin to adsorb gold cyanide;

c. removing the aqueous organic solvent solution;

d. contacting the weak base anion exchange resin with an aqueous strong base solution of from 0.1 to 1.0M NaOH or from 0.1 to 1.0M KOH to desorb gold cyanide; and e. removing the aqueous strong base solution, whereby gold cyanide is recovered in an aqueous strong base solution.

17. A method for stripping activated carbon-bound gold cyanide and recovering gold cyanide in an aqueous strong base solution comprising, in the following order:

a. contacting the activated carbon-bound gold cyanide with an aqueous solution comprising a strong base.

b. removing the aqueous strong base solution;

c. contacting the activated carbon-bound gold cyanide with an aqueous organic solvent selected from the group consisting of acetonitrile, alcohols having from one to four carbon atoms, and ketones having from three to six carbon atoms to remove gold cyanide from the activated carbon to provide a gold cyanide-containing basic, aqueous organic solvent solution;

d. adjusting the pH of the gold cyanide-containing basic, aqueous organic solvent solution to from about 5.0 to about 7.0;

e. contacting the aqueous organic solvent solution with a weak base anion exchange resin to adsorb gold cyanide;

f. removing the aqueous organic solvent solution:

g. contacting the weak base anion exchange resin with an aqueous strong base solution to desorb gold cyanide; and h. removing the aqueous strong base solution, whereby gold cyanide is recovered in an aqueous strong base solution.

18. The method of claim 17 wherein said organic solvent is from 5 to 100% (v/v) acetonitrile.

* * * * *